US006237233B1

(12) United States Patent
Cloutier et al.

(10) Patent No.: US 6,237,233 B1
(45) Date of Patent: May 29, 2001

(54) DOOR FRAME ADJUSTMENT APPARATUS

(76) Inventors: Robert J. Cloutier, P.O. Box 175; Jean Louis Ouellette, Thompson Rd., Box 27, both of South Londonderry, VT (US) 05155; Gerard Allain, P.O. Box 1014, Buctouch, NB (CA), E0A1G0

( * ) Notice: Subject to any disclaimer, the term of this patent is extended or adjusted under 35 U.S.C. 154(b) by 0 days.

(21) Appl. No.: 09/417,221

(22) Filed: Oct. 13, 1999

(51) Int. Cl.[7] ..... E04F 21/00
(52) U.S. Cl. ..... 33/194; 33/667
(58) Field of Search ..... 33/194, 404, 562, 33/749.1, 667

(56) References Cited

U.S. PATENT DOCUMENTS

| | | | | |
|---|---|---|---|---|
| 481,245 | | 8/1892 | Ritterbeck . | |
| 509,582 | | 11/1893 | Ort . | |
| 773,176 | | 10/1904 | Washington . | |
| 880,252 | | 2/1908 | Tennent | 33/194 |
| 1,004,471 | | 9/1911 | Rose . | |
| 1,101,517 | * | 6/1914 | Ahlvin | 33/194 |
| 1,115,030 | | 10/1914 | Smith . | |
| 1,687,532 | * | 10/1928 | Waltke | 33/194 |
| 1,946,961 | | 2/1934 | Blade | 33/194 |
| 2,511,900 | | 6/1950 | Bryant . | |
| 2,748,493 | | 6/1956 | Williams . | |
| 2,771,688 | * | 11/1956 | Baker | 33/194 |
| 2,867,911 | | 1/1959 | Atkinson | 33/194 |
| 2,973,584 | | 3/1961 | Snapp . | |
| 3,834,034 | | 9/1974 | Berquist | 33/194 |
| 3,930,315 | | 1/1976 | Baskett . | |
| 4,794,700 | | 1/1989 | Kessel | 33/194 |
| 5,167,073 | * | 12/1992 | Stein | 33/194 |
| 5,560,112 | * | 10/1996 | Stein et al. | 33/194 |

* cited by examiner

*Primary Examiner*—Andrew H. Hirshfeld
*Assistant Examiner*—R. Alexander Smith
(74) *Attorney, Agent, or Firm*—John J. Welch Jr, Esq

(57) ABSTRACT

The instant invention is a door frame adjustment apparatus that is four-sided and horizontally adjustable consisting of a slideably adjustable scale component, and corresponding adjustable bar component, vertically and horizontally aligned adjustable locking members, adjustable hinge units, horizontally aligned bubble leveling components, stabilizing members, magnetic stripping continuously affixed to the edging of one lateral side thereof and to a portion of a top side thereof and spacing within the lateral sides to facilitate affixation of door frame units to interior walling of an opening within building framing serving to encase the door frame unit.

8 Claims, 16 Drawing Sheets

DOOR FRAME ADJUSTMENT APPARATUS

BACKGROUND OF THE INVENTION

1. Field of the Invention

Figure 1:
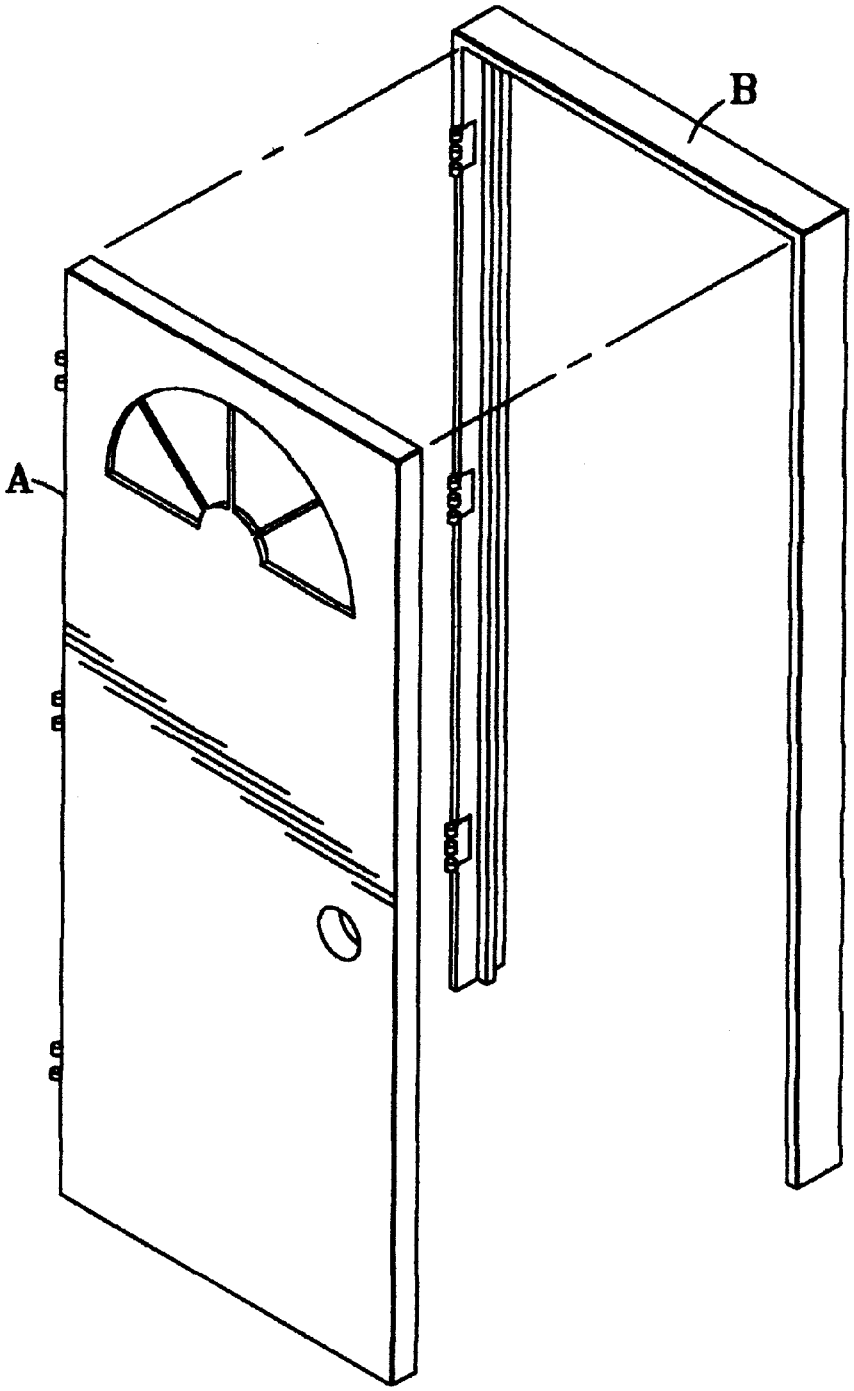
FIG. 1 PRIOR ART

The instant invention relates to that field of devices that are utilized for the leveling and squaring of door frames.

2. Prior Art

The accompanying Informational Art Statement delineates art that however does not anticipate the instant invention.

A SUMMARY OF THE INVENTION

1. A Brief Description of the Invention

The instant invention is rectangularly shaped and is amenable to being fitted to any conventional door frame unit. Each half of the invention is able to be adjusted sidewise by virtue of the presence of an adjustable slideable scale bar in a top side thereof and a corresponding adjustable, slideable bar located within the bottom side thereof. A pair of adjustable vertically aligned locking members affixed to the top side permit a tightening of the invention to a top side of a wooden door frame unit. A pair of adjustable horizontally aligned locking members affixed to the bottom side thereof, permit a tightening of the invention to lateral sides of a door frame. A plurality of adjustable hinge units affixed to the right lateral side of the invention permit affixation of the invention to hingeholders affixed to a door frame unit in the same manner that hinges on a door would be affixed to hingeholders of a door frame unit. The right lateral side of the invention is further characterized by the presence of a pair of horizontally aligned bubble leveling components. There is a plurality of laterally positioned spaces within each lateral side of the invention serving to facilitate the nailing of the door frame unit to shim pieces placed between the door frame unit and the building frame encasing the door frame unit and in turn to the building frame. Also, there are two horizontally aligned stabilizing members that are horizontally adjustable that hold the instant invention in place within a door frame unit while it is being locked fast to the door frame unit. Finally, affixed along the exterior edging of an upper portion of the right lateral side of the invention and continuously along the exterior edging of the half of the top side connected to the uppermost portion of the right lateral side thereof, there is a magnetized metallic strip. The magnetic strip facilitates stabilized affixation of the invention to a metallic door frame unit to facilitate the hanging of metal doors.

Utilization of the invention permits one to readily and strategically place shim pieces between a wooden door frame unit and building frame serving to encase it, so that prior to the hanging of a door, an installed door frame unit would be virtually perfectly square with respect to the lie of the building frame serving to encase it thereby permitting quick and ready door hanging so as to render the door, without the need for perhaps any planing or cutting thereof be also virtually perfectly square with respect to the lie of such building framing. Utilization of the invention permits one to moreover also appropriately adjust a metallic door frame unit so as to be perfectly square as respects building framing circumscribing the unit so that a metal door would then be likewise quickly readily and dependably hung by affixation thereto.

2. Objects of the Invention

As matters currently stand, the properly square hanging of a door and door frame combination within the confines of a building frame opening available for such purposes is a relatively formidable task. For the most part, such hanging requires the skills of highly qualified carpenters. The inherent difficulty in accomplishing the same lies in the fact that far too often, the building frame opening itself, would not be perfectly square in relationship to the lines of a given door and frame sought to be hung therein. Consequently, two persons, one of whom would be an experienced carpenter are required to manipulate a level, hold the door frame, shim it and nail it into place within the building frame unit so as to render the door frame unit as perfectly square as possible with respect to the lie of the building frame unit to which it would be attached. Such an undertaking to be done correctly takes a goodly amount of time and effort. It was in response to the fact of such a dilemma that the instant invention was conceived and then created. The instant invention enables just one person without necessarily the expertise of a highly skilled carpenter to easily affix a door frame unit to an encasing building frame quickly, readily and invariably dependably in such a manner that a hung door will be virtually perfectly square with respect to the lie of the perimeter of the opening within the building frame unit to which the door frame unit would be affixed. Moreover, due to the feature of side to side adjustability of the invention, doors of many sizes can be hung by just one person utilizing the instant invention in the manner outlined above. Also, as noted above, the invention is amenable to facilitating the hanging of both wooden and metallic doors.

Respectfully submitted, for the reasons cited above, the instant invention is not only new and unique but unquestionably useful as well.

A DESCRIPTION OF THE DRAWINGS

1. FIG. 1 depicts a door and corresponding door frame unit.

Figure 2:
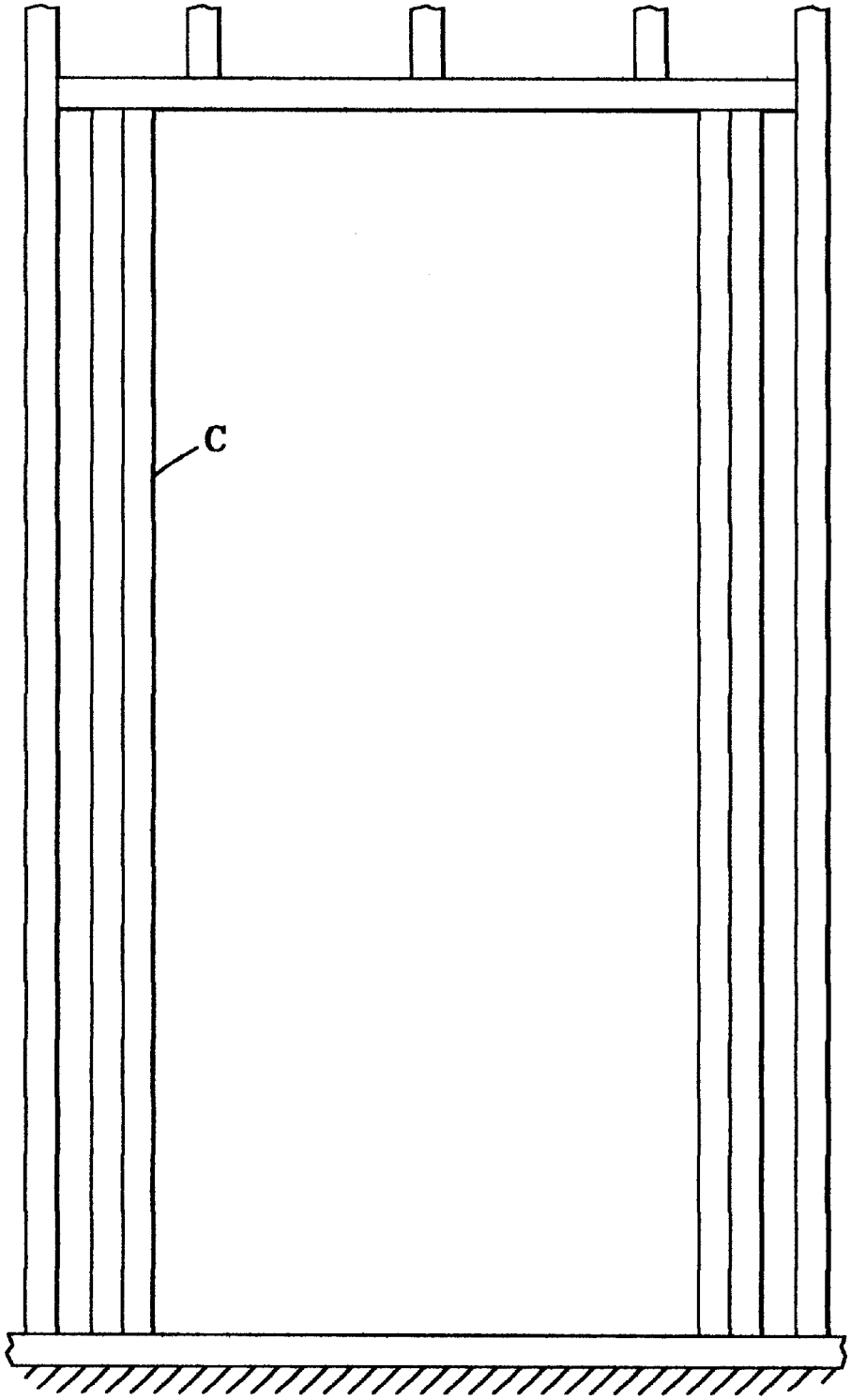

2. FIG. 2 depicts an opening within a building frame unit.

Figure 3:
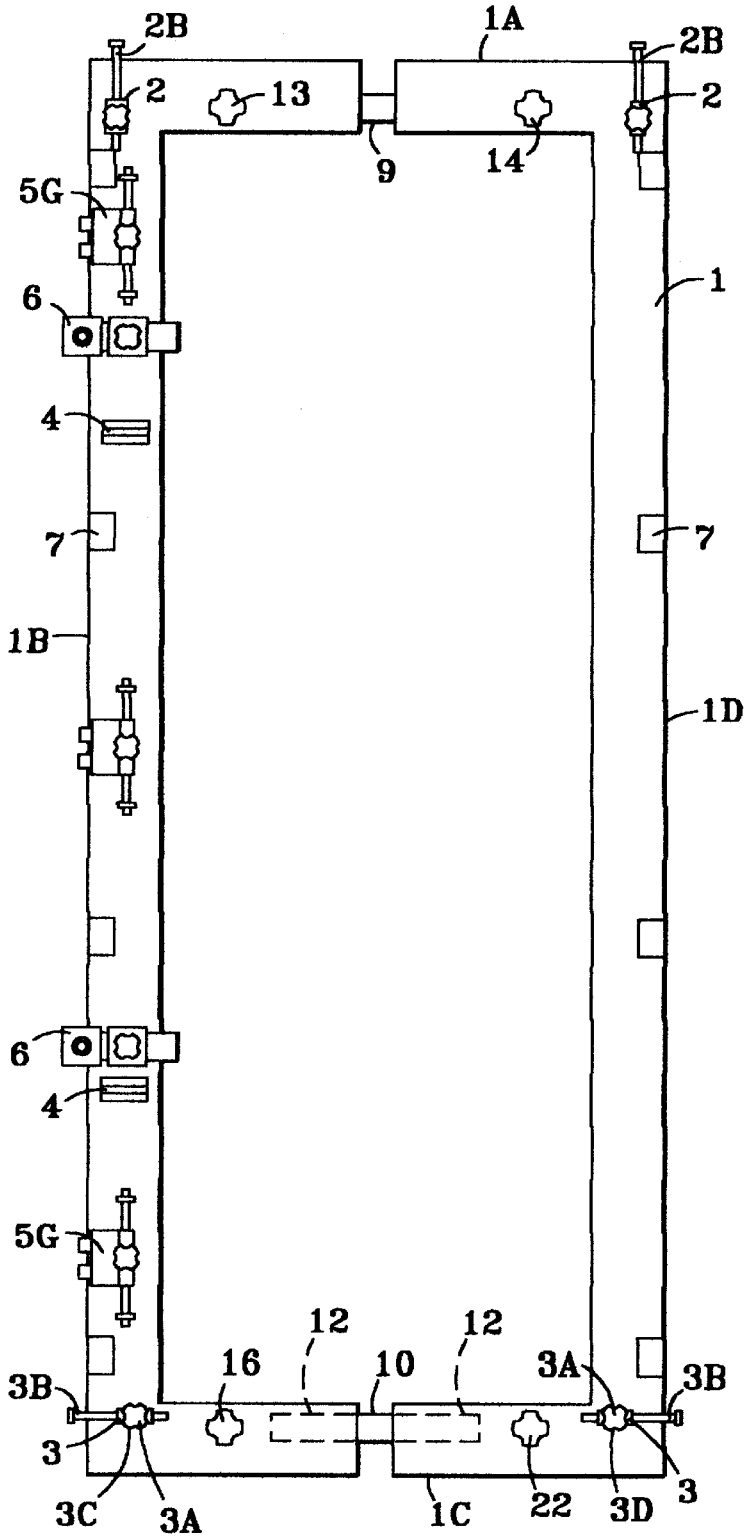

3. FIG. 3 is a frontal plan view of the invention.

Figure 4:
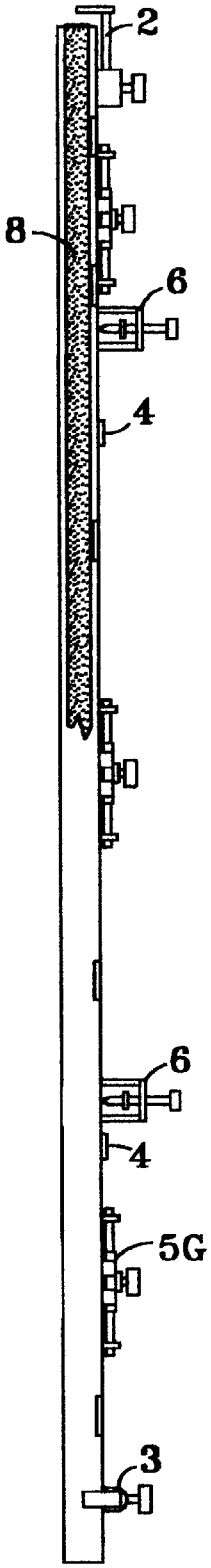

4. FIG. 4 is a lateral plan view of the left lateral side of the invention.

Figure 5:
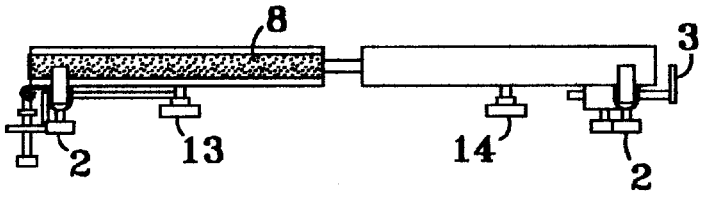

5. FIG. 5 is a top plan view of one-half of the top side and a bottom plan view of the bottom side of the invention.

Figure 6:
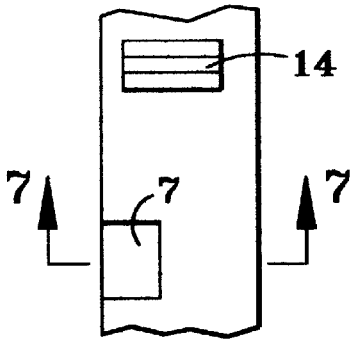

6. FIG. 6 is a close-up cutaway view of one of the bubble leveler components of the invention.

Figure 7:
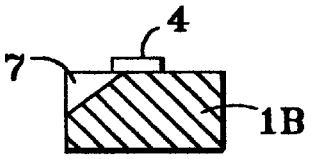

7. FIG. 7 is a sagitally cut cross-sectional view in the vicinity of one of the nailing spaces in the left lateral side of the invention.

Figure 8:
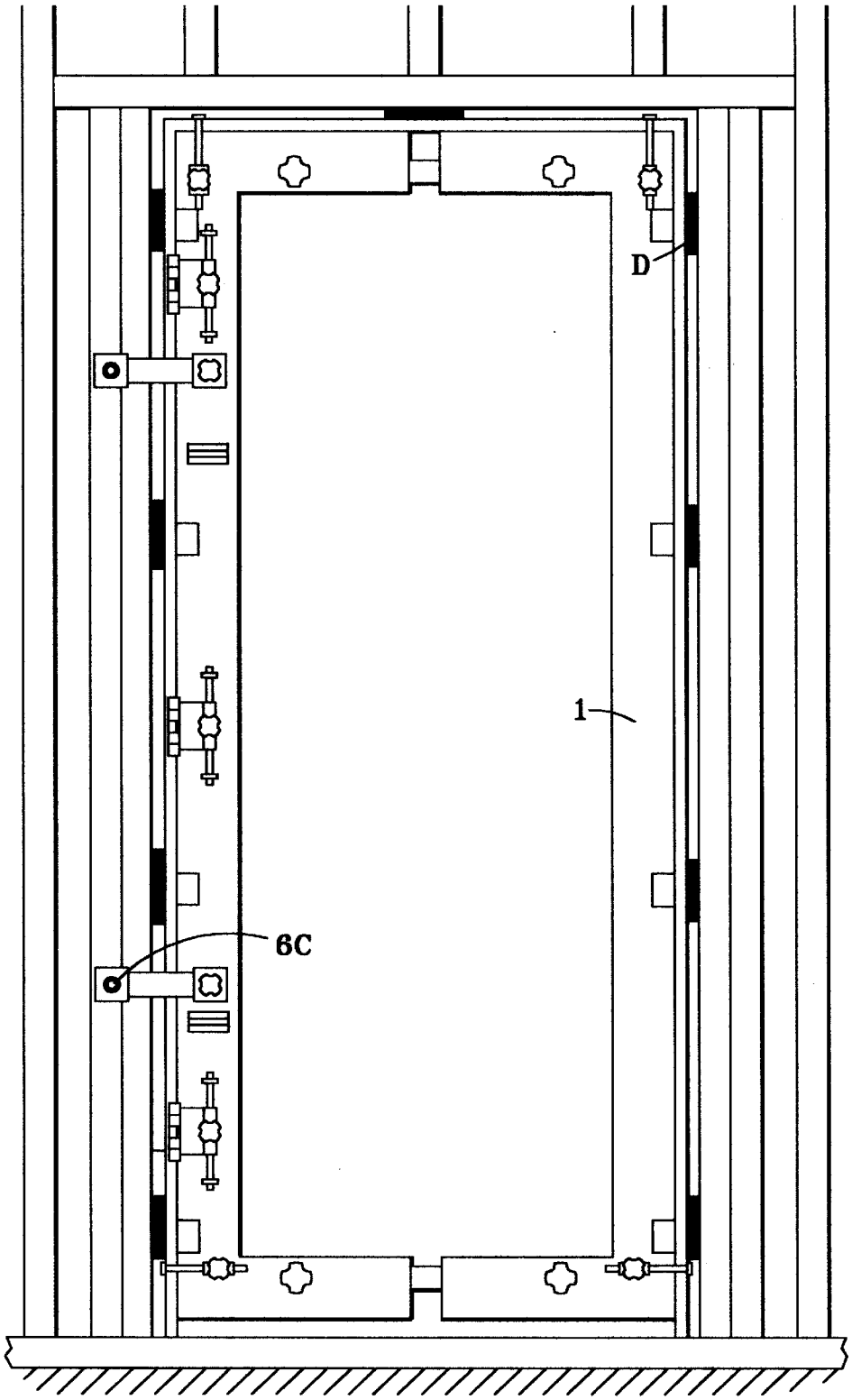

8. FIG. 8 is a frontal plan view of the invention affixed to a door frame unit shimmed into a building frame opening.

Figure 9:
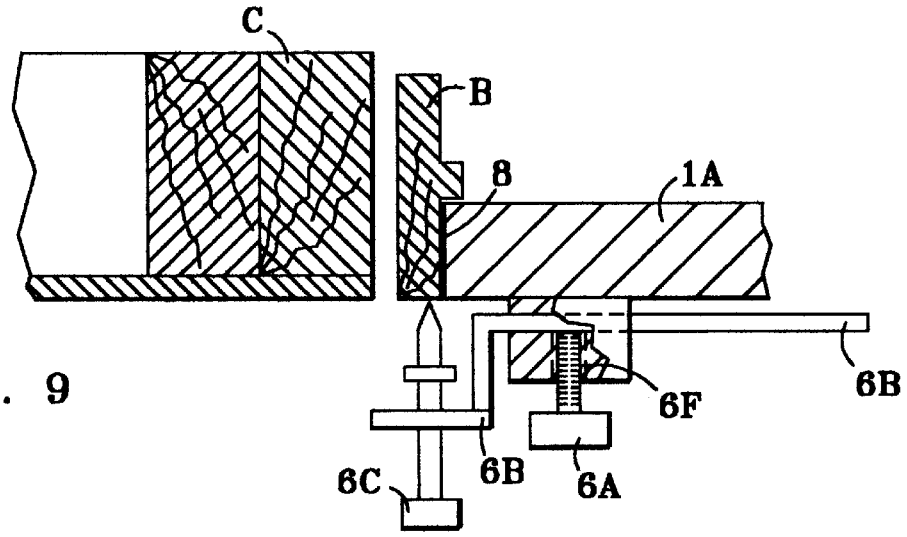

9. FIG. 9 is a cutaway cross-sectional view of a portion of the left lateral side of the invention in apposition to a door frame unit within a building frame unit.

Figure 10:
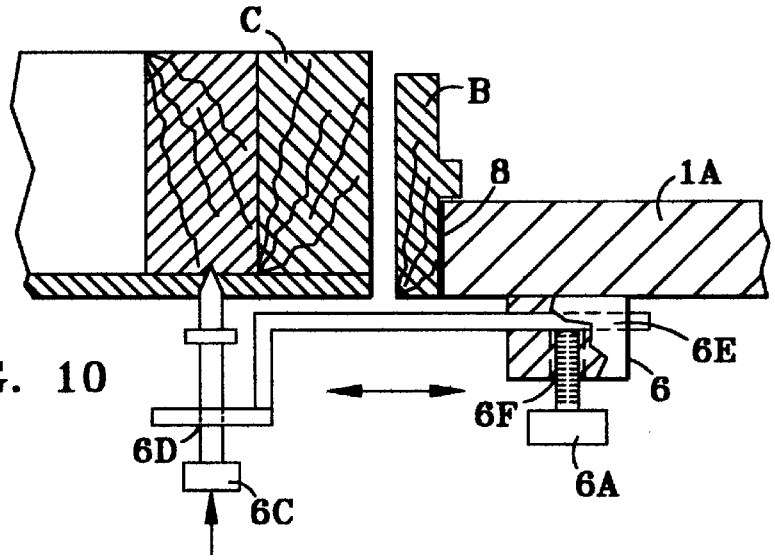

10. FIG. 10 depicts what is seen in FIG. 9 but demonstrating affixability of the invention to a building frame unit by way of resort to adjustment; one of the stabilizing members of the invention.

Figure 11:
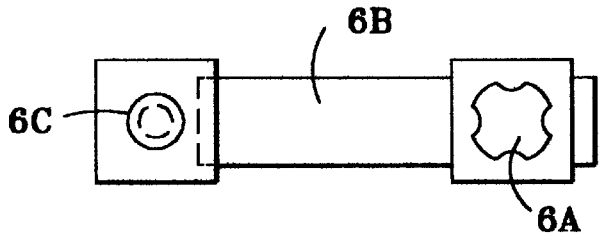

11. FIG. 11 is a frontal plan view of one of the stabilizing members of the invention.

Figure 12:
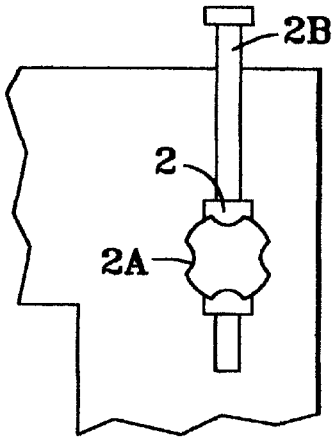

12. FIG. 12 is a frontal plan view of one of the vertically aligned locking members of the invention.

Figure 13:
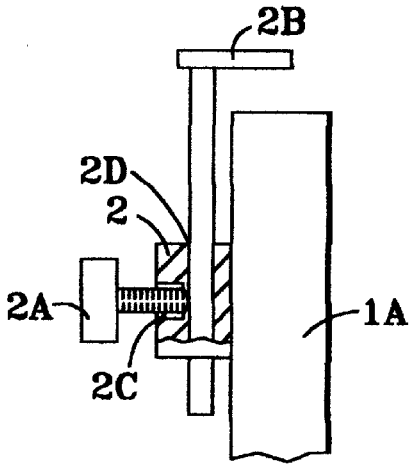

13. FIG. 13 is a lateral plan view of what is seen in FIG. 12.

Figure 14:
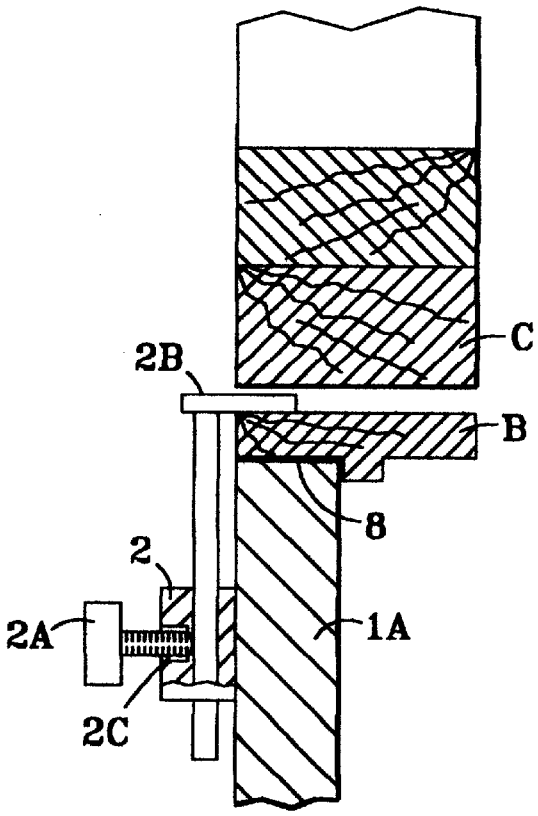

14. FIG. 14 illustrates the manner of operation of the locking member seen in FIG. 12.

Figure 15:
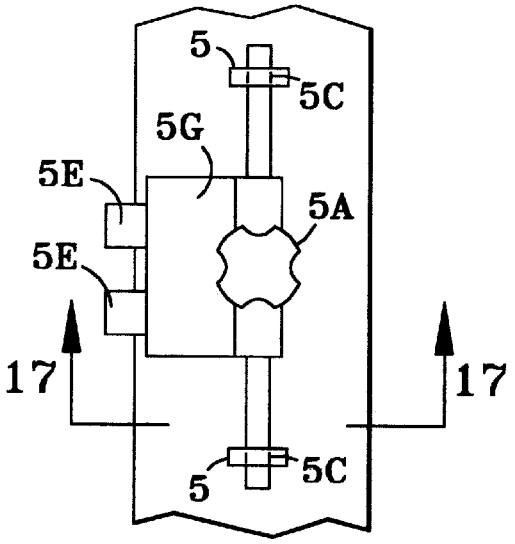

15. FIG. 15 is a frontal plan view of one of the adjustable hinge unit components of the invention.

Figure 16:
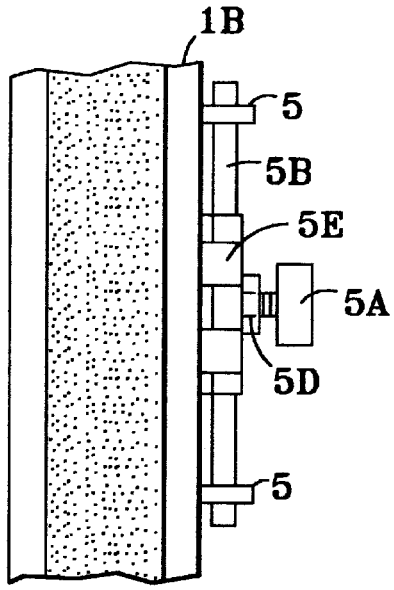

16. FIG. 16 is a lateral plan view of what is seen in FIG. 15.

Figure 17:
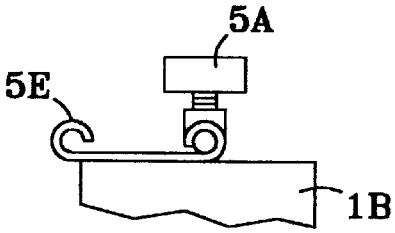

17. FIG. 17 is an isolated bottom plan view of one of the adjustable hinge unit component of the instant invention.

Figure 18:
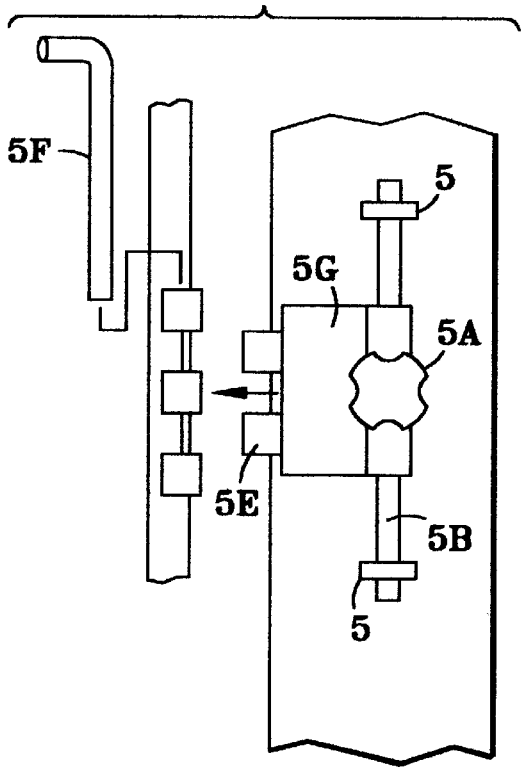

18. FIG. 18 is an isolated frontal plan view of one of the adjustable hinge unit components of the instant invention in apposition to a door frame hingeholder unit.

Figure 19:
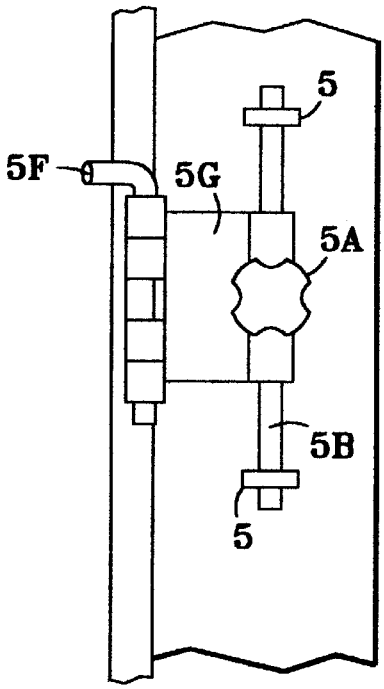

19. FIG. 19 is an isolated frontal plan view of the one of the adjustable hinge unit components seen in FIG. 18 but conjoined with a door frame hingeholder unit.

Figure 20:
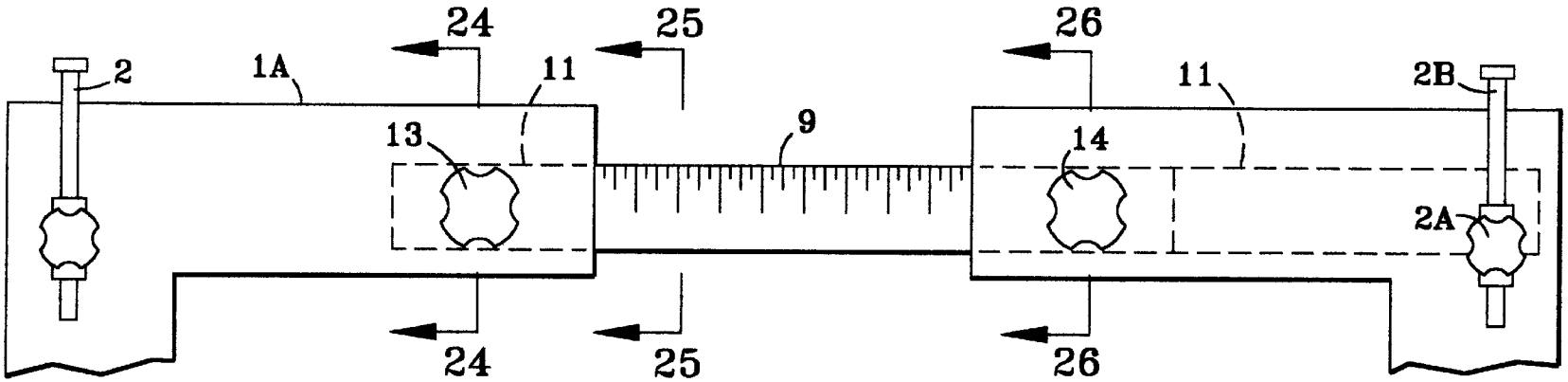

20. FIG. 20 is an isolated frontal plan view of the top side of the instant invention.

Figure 21:
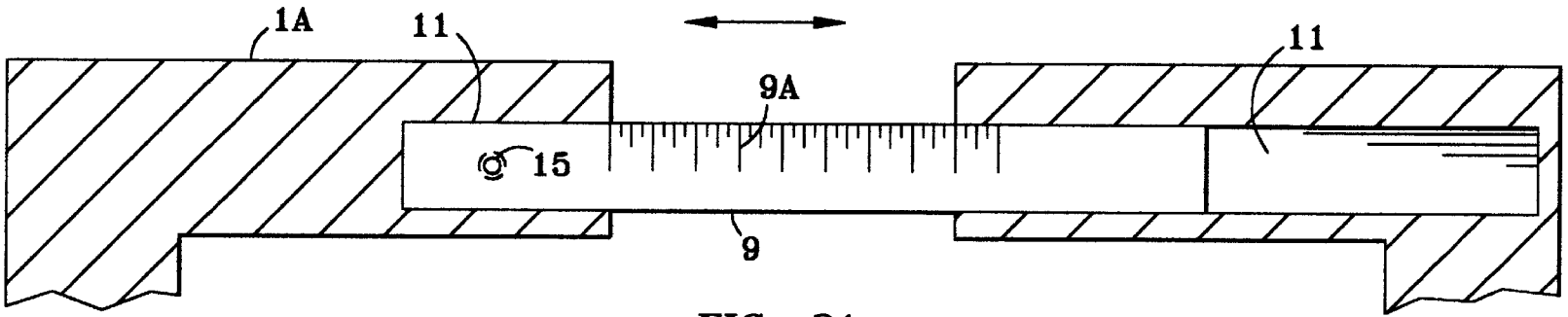

21. FIG. 21 is an isolated cross-sectional view of what is depicted in FIG. 20.

Figure 22:
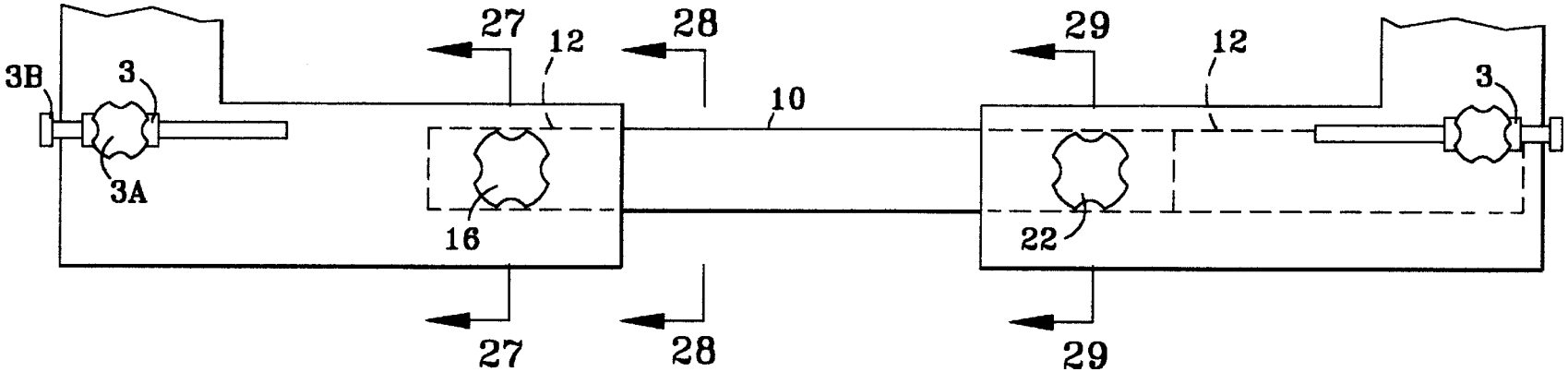

22. FIG. 22 is an isolated frontal plan view of the bottom side of the instant invention.

Figure 23:
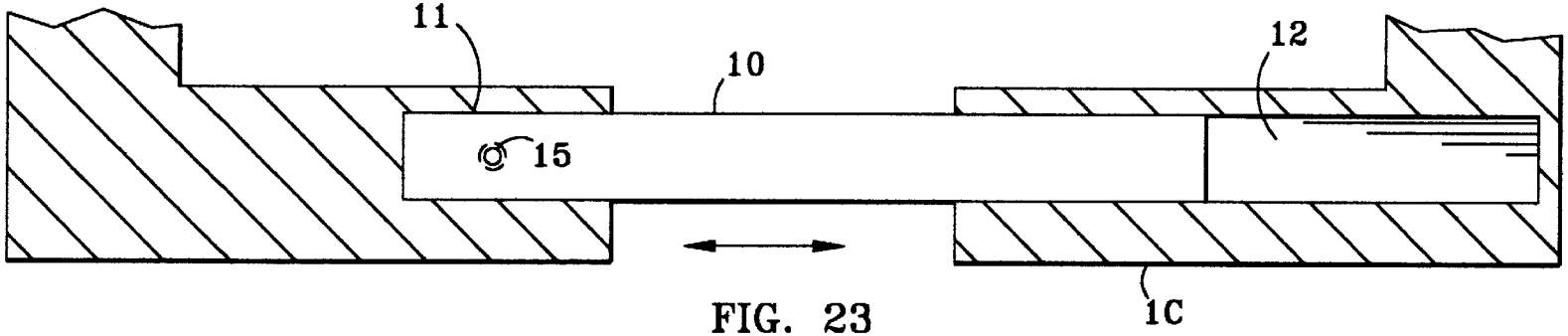

23. FIG. 23 is an isolated cross-sectional view of what is depicted in FIG. 22.

Figure 24:
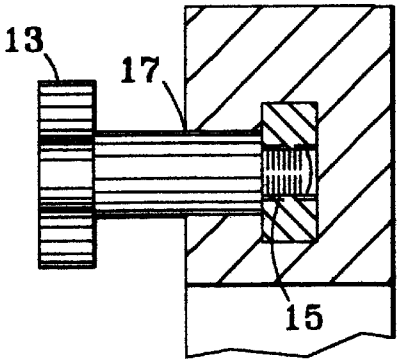

24. FIG. 24 is an isolated cross-sectional view of a threaded slideablc scale holding bolt component of the instant invention.

Figure 25:
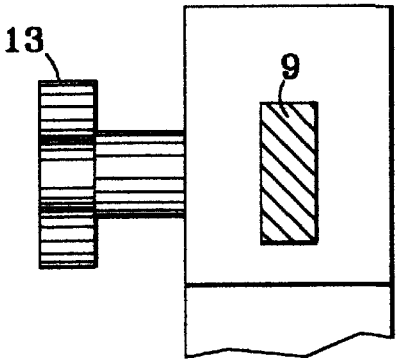

25. FIG. 25 is an isolated cross-sectional view of the in-lace slideable scale component of the instant invention.

Figure 26:
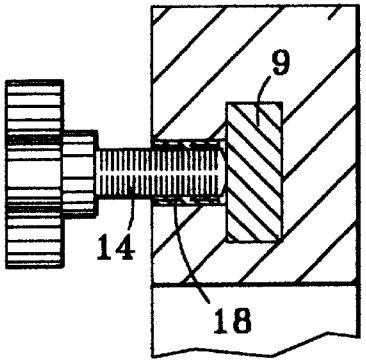

26. FIG. 26 is an isolated cross-sectional view of a threaded slideable scale tightening bolt component of the instant invention.

Figure 27:
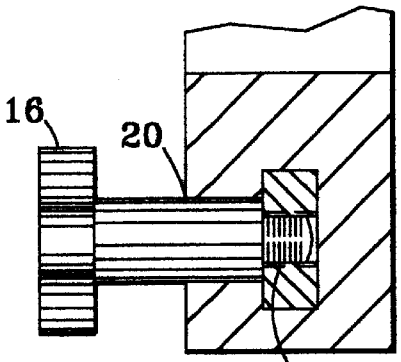

27. FIG. 27 is an isolated cross-sectional view of a threaded slideable bar component of the instant invention.

Figure 28:
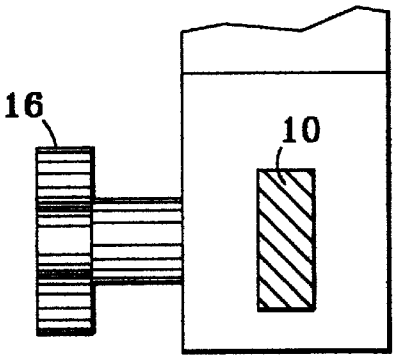

28. FIG. 28 is an isolated cross-sectional view of the in-lace slideable bar component of the instant invention.

Figure 29:
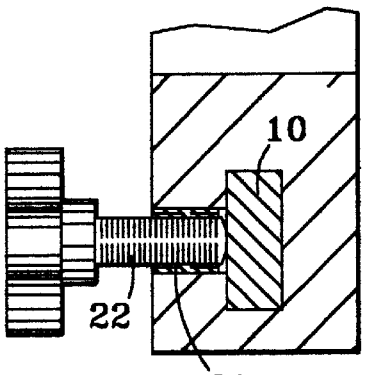

29. FIG. 29 is an isolated cross-sectional view of a threaded slideable bar tightening bolt component of the instant invention.

Figure 30:
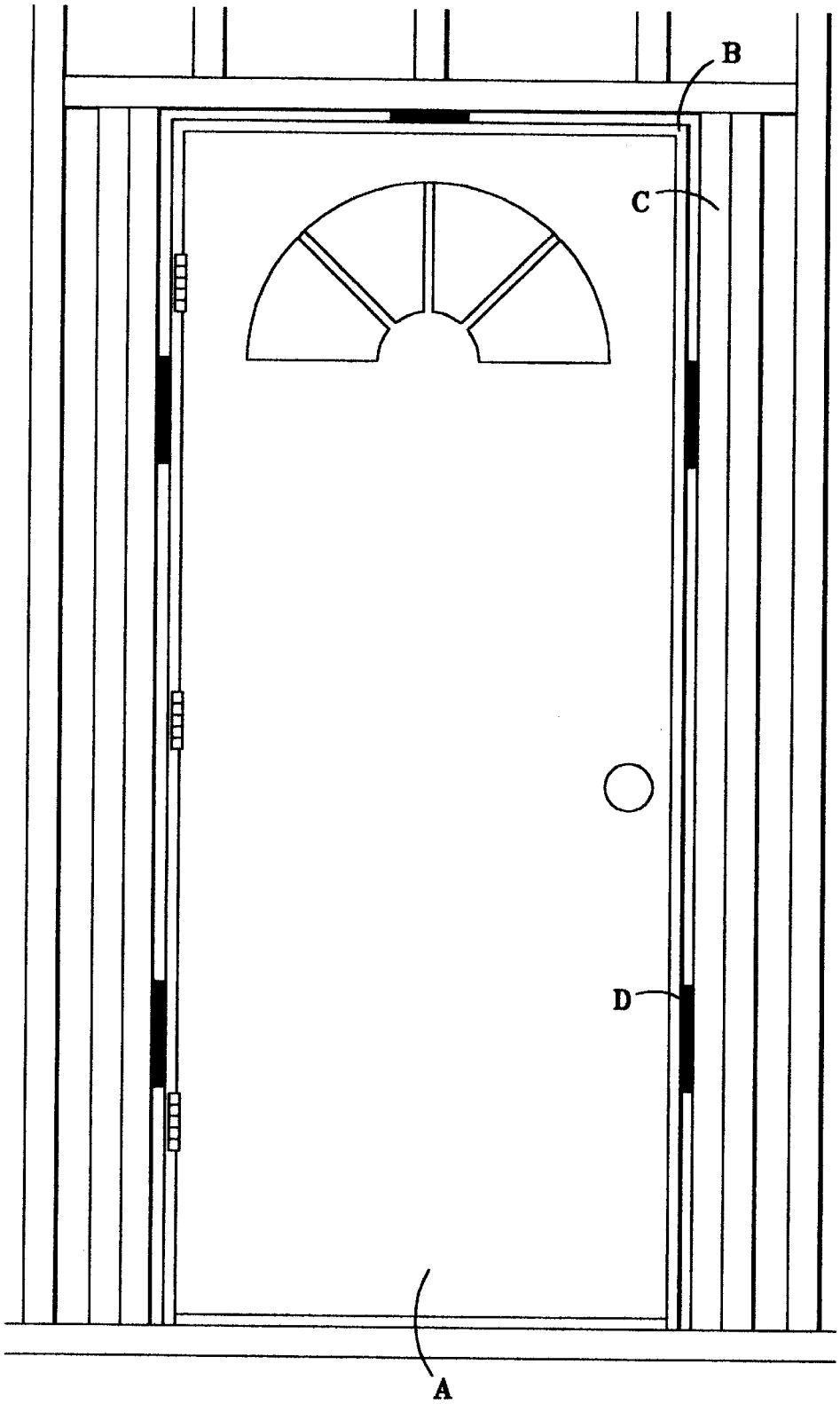

30. FIG. 30 is a frontal plan view of a virtually, perfectly square newly hung wooden door.

Figure 31:
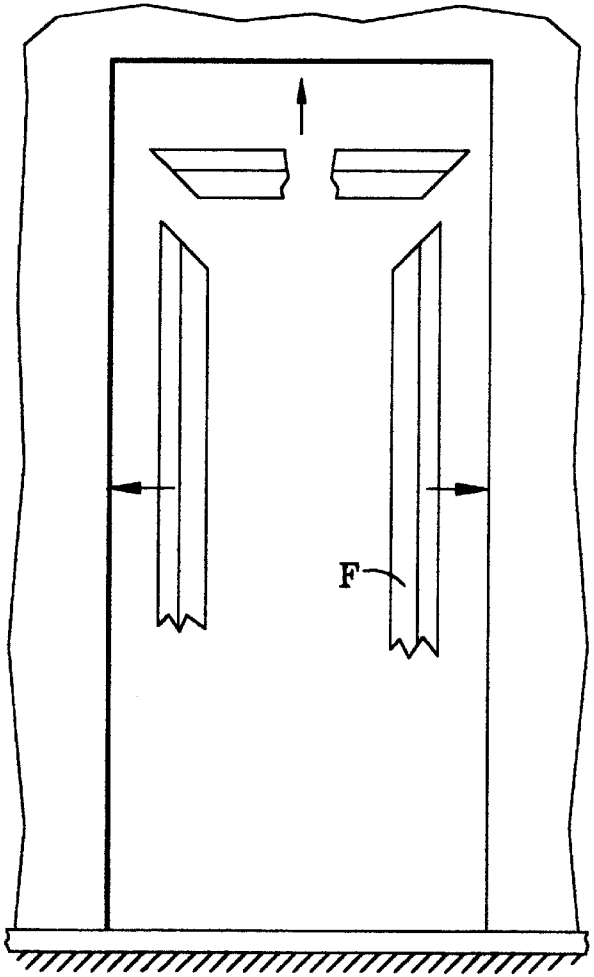
FIG. 31 PRIOR ART

31. FIG. 31 is a frontal plan view of component pieces of a metallic door frame unit.

Figure 32:
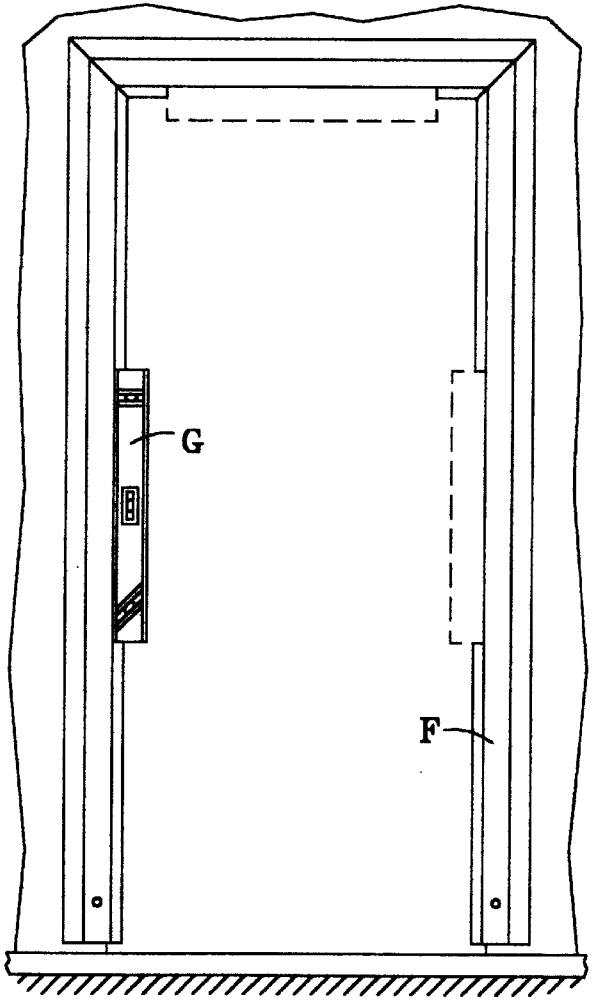
FIG. 32 PRIOR ART

32. FIG. 32 is a frontal plan view of a metallic door frame unit installed perforce of resort to utilization of a carpenter's level.

Figure 33:
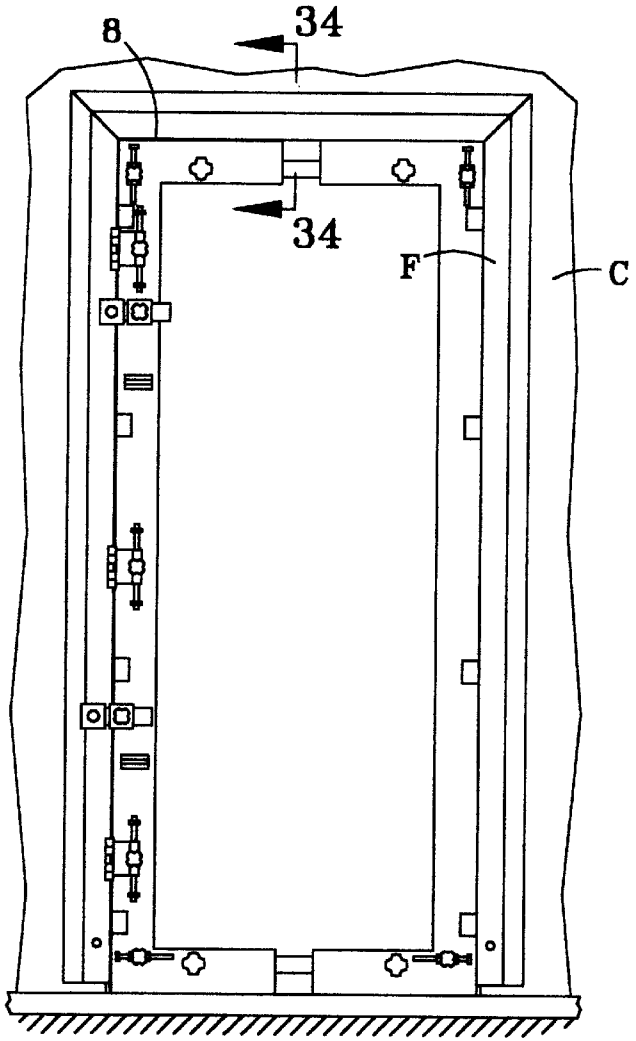

33. FIG. 33 is a frontal plan view of a metallic door frame unit installed perforce of resort to utilization of the instant invention.

Figure 34:
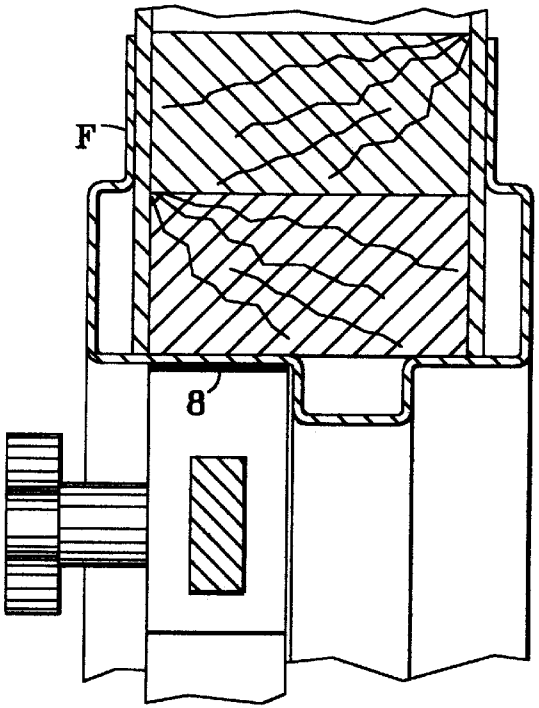

34. FIG. 34 is an isolated cross-sectional view of a portion of the topside of the instant invention in apposition to an installable metallic door frame unit.

Figure 35:
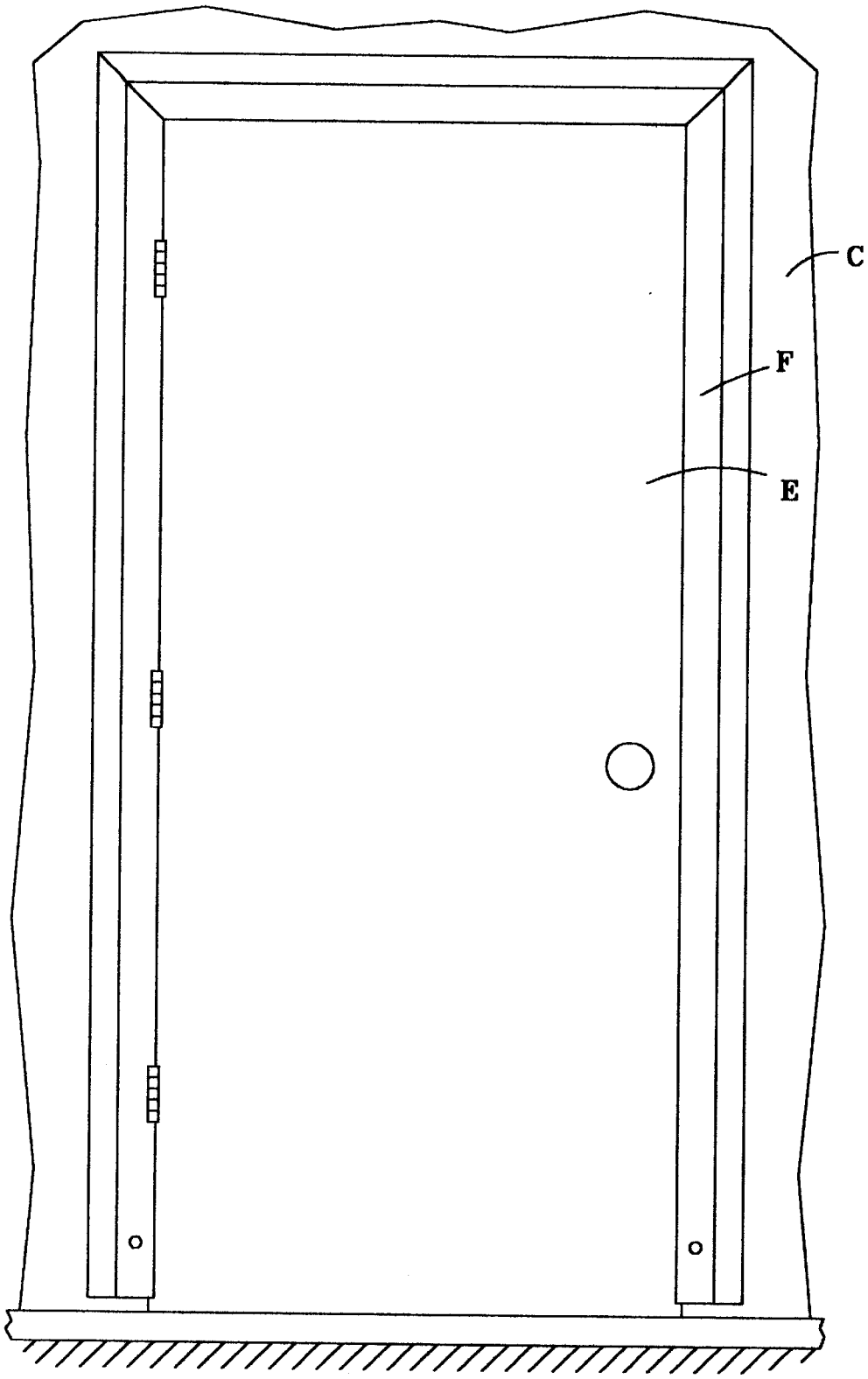

35. FIG. 35 is a frontal plan view of a virtually perfectly square newly hung wooden door.

A DESCRIPTION OF THE PREFERRED EMBODIMENT

As previously noted, the properly square hanging of a door A and door frame B combination as seen in FIG. 1 within the confines of a building frame opening C as seen in FIG. 2 is a relatively formidable task currently requiring the skills of highly qualified carpenters. The instant invention depicted in FIG. 3 however, enables just one person without necessarily the expertise of a highly skilled carpenter to easily, quickly, readily and dependably accomplish the task and in such a manner that a hung door A will be virtually perfectly square with respect to the lie of the perimeter of the opening C within that building frame unit to which a door frame unit B would have been affixed. FIG. 8 demonstrates utilization of the instant invention in contemplation of a hanging of a wooden door by one person not highly skilled as a carpenter as seen in FIG. 30. FIGS. 33 and 35 illustrate the same but with respect to the hanging of a metallic door E within a metallic door frame F shown also in FIGS. 31, 32 and 34.

The invention consists of a rectilinearly shaped frame unit 1 with top side 1A, right lateral side 1B, bottom side 1C and left lateral side 1D all as seen in FIG. 3. Two vertically aligned locking members 2 as seen in FIGS. 3, 12, 13 and 14 are affixed to a frontal facade of rectilinearly shaped frame unit 1 near top side 1A thereof. Each of members 2 consists of an inverted L-shaped vertically aligned locking member bar 2B, a horizontally aligned through hole 2C, a vertically aligned through hole 2D for receipt of member bar 2B and a horizontally aligned threaded locking member bolt 2A insertable into hole 2C; all as can be seen with reference to FIGS. 12 and 13. Member bar 2B fits between door frame unit B and building frame unit C as seen in FIG. 14. There are as well, two horizontally aligned locking members 3 affixed to the frontal facade of rectilinearly shaped frame unit 1 near bottom side 1C thereof. Each of members 3 consists of an inverted L-shaped horizontally aligned locking member bar 3B, a horizontally aligned through hole 3D within each member 3 for receipt of a member bar 3B, a closed threaded base hole 3C in a member bar 3B and a horizontally aligned threaded locking member base bolt 3A insertable into hole 3C, all as can be seen with reference to FIG. 3. A pair of horizontally aligned bubble level components 4 are affixed to right lateral side 1B of unit 1 as can be seen with reference to FIGS. 3 and 8. Also notable with reference FIG. 3 are a plurality of equivalent adjustable hinge units. FIGS. 15 through 19 serve to illustrate the essential features of these hinge units of the invention ultimately attached by way of of equivalent base units 5 to right lateral side 1B as seen in FIGS. 3 and 4. In addition to base units 5, there is to be seen in each, a vertically aligned hinge bar unit 5B, a vertically aligned hinge bar through hole 5C in a base unit 5 for receipt of a hinge bar unit 5B, a horizontally inclined closed threaded hinge component hole 5D in each unit plate 5G of each such unit, a horizontally inclined hinge bar tightening bolt 5A insertable into a hinge component hole 5D and each hinge component features as well as a pair of equivalent hooks 5E affixed to one hinge bar unit 5B. A hinge pin 5F angulated near one end thereof fits into each of hinge hooks 5E. There are also to be seen with reference to FIGS. 3, 9, 10 and 11, a pair of adjustable, horizontally aligned stabilizing members attached to right lateral side 1B of unit 1. Each stabilizing member consists of a base unit 6, a horizontally aligned stabilizing bar 6B, a nail hole 6D through bar 6B, a stabilizing nail 6C insertable through hole 6D, a threaded stabilizing member tightening bolt 6A revolvable within a horizontally inclined threaded hole 6F located within each base unit 6 and a sleeve within each base unit 6 for receipt of one end of a stabilizing bar 6B. A plurality of laterally positioned spaces 7 are seen in sides 1B and 1D of unit 1 as can be noted with reference to FIGS. 6, 7 and 33. A slideable bar component 10 comprising a medial portion of bottom side 1C of unit 1 is held within each of a pair of bottom side compartments 12 found one each within the respective lateral portions of bottom side 1C all as can be seen with resort to FIGS. 22 and 23. A rectangularly shaped slideable scale component 9 featuring measurement etchings 9A as featured in FIGS. 20, 21 and 25 comprising a medial portion of top side 1A of unit 1 is held within each of a pair of top side compartments 11 found each within the respective lateral portions of top side 1A. A threaded slideable scale holding bolt component 13 insertable into a first topside closed hole 17 is notable with reference to FIGS. 20 and 24. A threaded slideable scale tightening bolt component 14 insertable into a second topside closed hole 18 is featured in FIGS. 20 and 26. A slideable scale holding bolt through hole 15 is seen in FIGS. 21 and 24 for receipt of holding bolt component 13. A threaded slideable bar holding bolt component 16 is seen in FIGS. 27 and 28 as is first bottom side bar through hole 20 in FIG. 27 for receipt of bolt component 16. A threaded slideable bar tightening bolt component 22 inscrtable into a second bottom side closed hole 21 is seen with reference to FIGS. 3 and 29. A slideable bar holding bolt hole 19 is seen in FIG. 27 for receipt of holding bolt component 16. FIGS. 4 and 5 illustrate metallic magnetic stripping 8 affixed to an upper portion of right lateral side 1B and to a right lateral one of the lateral portions of top side 1A of unit 1.

As earlier noted, the instant invention renders possible the quick, ready and eminently dependable hanging of a wooden door by just one person who need not be an experienced carpenter. Door frame B is suitably affixed to frame opening C. Unit 1 is then attached to frame B by way of nailing it thereto via two stabilizing nails 6C as per FIGS. 8 and 10. Components 6 serve to enable the initial affixation of unit 1 ultimately to frame unit C as seen in FIG. 8 by just one person via affixation of unit 1 to frame B. Unit 1 is then adjusted to the width of frame B by way of the adjustment of slideable scale component 9 and slideable bar component 10 and then by suitably turning bolts 13 and 14 respectively and bolts 16 and 22 respectively to hold scale component 9 and bar component 1D tightly such that sides 1B and 10 fit tightly to inner wallig of frame unit B. Then hinge hooks 5E are inserted into the recipient hinge units on frame B and held in place by hinge pins 5F. Then vertically aligned locking members 2 and horizontally alliged locking members 3 are adjusted to hold unit 1 tightly to frame unit B between it and frame opening C in the manner depicted in FIGS. 13, 14 and 3. Such adjustments are made by way of adjusting locking member bars 2 and 3 and then tightening them in place by way of turning bolts 2A and 3A. At this juncture, shim pieces D of varied breadth are placed between frame B and frame opening C such as can be appreciated with reference to FIG. 8 until bubble level components 4 depict a purely level lie. At this juncture, frame unit B is nailed to shim pieces D and held fast to the inner walling of frame opening C by way of nails insertable via spaces 7. With this process then complete, frame B is shimmed perfectly level with respect to frame opening C without any need for resort to the use of a carpenter's level G depicted in FIG. 32. At this juncture, it should be pointed out that but for the instant invention, one person holding a level G would be needed to call out levels to another person seeking to adjust and affix a frame unit B to level with respect to a frame opening C. Unit 1 is then removed from frame unit B and replaced by a perfectly squared hung wooden door as seen in FIG. 30. A similar protocol is followed as respects the contemplated perfectly square hanging of a metal door E to a metallic door frame F. Metallic magnetic stripping 8 facilitates the holding of unit 1 to a frame F while components 6 initially hold unit 1 in place as noted above. Once member bars 2A and 3A are tightened, after proceeding as noted above to this step, then, frame F is pulled at the base thereof at one lowest comer thereof until bubble level components 4 depict a purely level lie. Then, frame F is nailed at both lowest comers thereof to the flooring below the locus of inlaid unit 1 and is done so without any need to resort to the use of a carpenter's level G depicted in FIG. 32 all as earlier noted with reference to FIG. 33. It is worth noting here as well that it would likewise take one person holding a level G and another person to nail down a frame F but for the fact of the instant invention. Unit 1 is then removed from frame unit F and replaced by a perfectly square hung metallic door E as seen in FIG. 35.

In conclusion, respectfully submitted, the instant invention is, in view of the foregoing, not only new, useful and unique but is indeed virtually revolutionary within the art of hanging doors.

What is claimed is:

1. A door frame adjustment apparatus, comprising:

a. a rectilinearly shaped frame unit;

b. a pair of vertically aligned locking members affixed to a frontal facade of said rectilinearly shaped frame unit near a top side thereof;

c. each of said vertically aligned locking members consisting of an inverted L-shaped vertically aligned locking member bar, a vertically aligned through hole within said locking member for receipt of said locking member bar, a horizontally aligned closed threaded hole in said locking member and a horizontally alignable threaded locking member bolt insertable into said closed threaded hole;

d. a pair of horizontally aligned locking members affixed to said frontal facade of said rectilinearly shaped frame unit near a bottom side thereof;

e. each of said horizontally aligned locking members consisting of an inverted L-shaped horizontally aligned locking member bar, a horizontally aligned through hole within said locking member for receipt of said horizontally aligned locking member bar, a closed threaded base hole in said locking member and a horizontally aligned threaded locking member base bolt insertable into said closed threaded base hole;

f. a pair of horizontally aligned bubble level components affixed to a right lateral side of said rectilinearly shaped frame unit;

g. a plurality of adjustable hinge components affixed by way of a pair of equivalent base units to said right lateral side of said rectilinearly shaped frame unit;

h. each of said adjustable hinge components consisting of said pair of equivalent base units, a unit plate, a vertically aligned hinge bar unit, a vertically aligned hinge bar through hole in each said base unit for receipt of one of said hinge bar unit, a horizontally inclined closed threaded hinge component hole in said plate, a horizontally inclined hinge bar tightening bolt insertable into said hinge component hole, and an equivalent pair of hinge hook units affixed to said hinge bar unit.

i. a pair of adjustable, horizontally aligned stabilizing members affixed to said right lateral side of said rectilinearly shaped frame unit;

j. each one of said adjustable horizontally aligned stabilizing members consisting of a base unit, a horizontally aligned stabilizing bar, a nail hole through said stabilizing bar, a stabilizing nail insertable through said nail hole, a threaded stabilizing member tightening bolt revolvable within a horizontally inclined threaded hole located within said each one of said adjustable, horizontally aligned stabilizing members and a sleeve for receipt of one end of one of said stabilizing bars;

k. a plurality of laterally positioned spaces located in said right lateral side of said rectilinearly shaped frame unit;

l. a plurality of laterally positioned spaces located in a left lateral side of said rectilinearly shaped frame unit;

m. a slideable bar component comprising a medial portion of said bottom side of said rectilinearly shaped frame unit and held within each of a pair of bottom side compartments found one each within respective lateral portions of said bottom side of said rectilinearly shaped frame unit;

n. a rectangularly shaped slideable scale component comprising a medial portion of said top side of said rectilinear shaped from unit held within each of a pair of top side compartments found one each within respective lateral portions of said top side of said rectilinearly shaped frame unit;

o. a threaded slideable scale holding bolt component;

p. a slideable scale holding bolt through hole for receipt of said threaded slideable scale holding bolt component;

q. a threaded slideable scale tightening bolt component;

r. a first topside closed hole for receipt of said threaded slideable scale holding bolt component;

s. a second topside closed hole for receipt of said threaded slideable scale tightening bolt component;

t. a threaded slideable bar holding bolt component;

u. a slideable bar through hole for receipt of said threaded slideable bar holding bolt component;

v. a threaded slideable bar tightening bolt component;

w. a first bottom side closed hole for receipt of said threaded slideable bar holding bolt component, and;

x. a second bottom closed hole for receipt of said threaded slideable bar tightening bolt component.

2. The door frame adjustment apparatus of claim 1 whereby said slideable scale component is characterized by the presence of measurement etchings thereupon.

3. A door frame adjustment apparatus, comprising:

a. a rectilinearly shaped frame unit;

b. a pair of vertically aligned locking members affixed to a frontal facade of said rectilinearly shaped frame unit near a top side thereof;

c. each of said vertically aligned locking members consisting of an inverted L-shaped vertically aligned locking member bar, a vertically aligned through hole within said locking member for receipt of said locking member bar, a horizontally aligned closed threaded hole in said locking member and a horizontally alignable threaded locking member bolt insertable into a said closed threaded hole;

d. a pair of horizontally aligned locking members affixed to said frontal facade of said rectilinearly shaped frame unit near a bottom side thereof;

e. each of said horizontally aligned locking members consisting of an inverted L-shaped horizontally aligned locking member bar, a horizontally aligned through hole within said locking member for receipt of said horizontally aligned locking member bar, a closed threaded base hole in said locking member and a horizontally aligned threaded locking member base bolt insertable into a said closed threaded base hole;

f. a pair of horizontally aligned bubble level components affixed to a right lateral side of said rectilinearly shaped frame unit;

g. a plurality of adjustable hinge components affixed by way of a pair of equivalent base units to said right lateral side of said rectilinearly shaped frame unit;

h. each of said adjustable hinge components consisting of said pair of equivalent base units, a unit plate, a vertically aligned hinge bar unit, a vertically aligned hinge bar through hole in each said base unit for receipt of one of said hinge bar unit, a horizontally inclined closed threaded hinge component hole in said plate, a horizontally inclined hinge bar tightening bolt insertable into said hinge component hole, and a pair of hinge hook units affixed to said hinge bar unit.

i. a pair of adjustable, horizontally aligned stabilizing members affixed to said right lateral side of said rectilinearly shaped frame unit;

j. each one of said adjustable horizontally aligned stabilizing members consisting of a base unit, a horizontally aligned stabilizing bar, a nail hole through said stabilizing bar, a stabilizing nail insertable through said nail hole, a threaded stabilizing member tightening bolt revolvable within a horizontally inclined threaded hole located within said each one of said adjustable, horizontally aligned stabilizing members and a sleeve for receipt of one end of one of said stabilizing bars;

k. a plurality of laterally positioned spaces located in said right lateral side of said rectilinearly shaped frame unit;

l. a plurality of laterally positioned spaces located in a left lateral side of said rectilinearly shaped frame unit;

m. a slideable bar component comprising a medial portion of said bottom side of said rectilinearly shaped frame unit and held within each of a pair of bottom side compartments found one each within respective lateral portions of said bottom side of said rectilinearly shaped frame unit;

n. a rectangularly shaped slideable scale component comprising a medial portion of said top side of said rectilinear shaped from unit held within each of a pair of top side compartments found one each within respective lateral portions of said top side of said rectilinearly shaped frame unit;

o. a threaded slideable scale holding bolt component;

p. a slideable scale holding bolt through hole for receipt of said threaded slideable scale holding bolt component;

q. a threaded slideable scale tightening bolt component;

r. a first topside closed hole for receipt of said threaded slideable scale tightening bolt component;

s. a second topside closed hole for receipt of said threaded slideable scale tightening bolt component;

t. a threaded slideable bar holding bolt component;

u. a slideable bar through hole for receipt of said threadable slideable bar holding bolt component;

v. a threaded slideable bar tightening bolt component;

w. a first bottom side closed hole for receipt of said threaded slideable bar holding bolt component;

x. a second bottom closed hole for receipt of said threaded slideable bar tightening bolt component, and;

y. metallic magnetic stripping affixed to an upper portion of said right lateral side of said rectilinearly shaped frame unit and to a right lateral one of said respective lateral portions of said top side of said rectilinearly shaped frame unit.

4. The door frame adjustment apparatus of claim 3 whereby said slideable scale component is characterized by the presence of measurement etchings thereupon.

5. A door frame adjustment apparatus, comprising:

a. a rectilinearly shaped frame unit;

b. a pair of vertically aligned locking members affixed to a frontal facade of said rectilinearly shaped frame unit near a top side thereof;

c. each of said vertically aligned locking members consisting of an inverted L-shaped vertically aligned locking member bar, a vertically aligned through hole within said locking member for receipt of said locking member bar, a horizontally aligned closed threaded hole in said locking member and a horizontally alignable threaded locking member bolt insertable into said closed threaded hole;

d. a pair of horizontally aligned locking members affixed to said frontal facade of said rectilinearly shaped frame unit near a bottom side thereof;

e. each of said horizontally aligned locking members consisting of an inverted L-shaped horizontally aligned locking member bar, a horizontally aligned through hole within said locking member for receipt of said horizontally aligned locking member bar, a closed threaded base hole in said locking member and a horizontally aligned threaded locking member base bolt insertable into said closed threaded base hole;

f. a pair of horizontally aligned bubble level components affixed to a right lateral side of said rectilinearly shaped frame unit;

g. a plurality of adjustable hinge components affixed by way of a pair of equivalent base units to said right lateral side of said rectilinearly shaped frame unit;

h. each of said adjustable hinge components consisting of said pair of equivalent base units, a unit plate, a vertically aligned hinge bar unit, a vertically aligned hinge bar through hole in each said base unit for receipt of one of said hinge bar unit, a horizontally inclined closed threaded hinge component hole in said plate, a horizontally inclined hinge bar tightening bolt insertable into said hinge component hole, and an equivalent pair of hinge hook units affixed to said hinge bar unit.

i. a pair of adjustable, horizontally aligned stabilizing members affixed to said right lateral side of said rectilinearly shaped frame unit;

j. each one of said adjustable horizontally aligned stabilizing members consisting of a base unit, a horizontally aligned stabilizing bar, a nail hole through said stabilizing bar, a stabilizing nail insertable through said nail hole, a threaded stabilizing member tightening bolt revolvable within a horizontally inclined threaded hole located within said each one of said adjustable, horizontally aligned stabilizing members and a sleeve for receipt of one end of one of said stabilizing bars;

k. a plurality of laterally positioned spaces located in said right lateral side of said rectilinearly shaped frame unit;

l. a plurality of laterally positioned spaces located in a left lateral side of said rectilinearly shaped frame unit;

m. a slideable bar component comprising a medial portion of said bottom side of said rectilinearly shaped frame unit and held within each of a pair of bottom side compartments found one each within respective lateral portions of said bottom side of said rectilinearly shaped frame unit;

n. a rectangularly shaped slideable scale component comprising a medial portion of said top side of said rectilinear shaped from unit held within each of a pair of top side compartments found one each within respective lateral portions of said top side of said rectilinearly shaped frame unit;

o. a threaded slideable scale holding bolt component;

p. a slideable scale holding bolt through hole for receipt of said threaded slideable scale holding bolt component;

q. a threaded slideable scale tightening bolt component;

r. a first topside closed hole for receipt of said threaded slideable scale holding bolt component;

s. a second topside closed hole for receipt of said threaded slideable scale tightening bolt component;

t. a threaded slideable bar holding bolt component;

u. a slideable bar through hole for receipt of said threaded slideable bar holding bolt component;

v. a threaded slideable bar tightening bolt component;

w. a first bottom side closed hole for receipt of said threaded slideable bar holding bolt component;

x. a second bottom closed hole for receipt of said threaded slideable bar tightening bolt component, and;

y. a pair of equivalent hinge pins each angulated near one end thereof and each insertable into one of said equivalent pairs of hinge hooks.

6. The door frame adjustment apparatus of claim 5 whereby said slideable scale component is characterized by the presence of measurement etchings thereupon.

7. A door frame adjustment apparatus, comprising:

a. a rectilinearly shaped frame unit;

b. a pair of vertically aligned locking members affixed to a frontal facade of said rectilinearly shaped frame unit near a top side thereof;

c. each of said vertically aligned locking members consisting of an inverted L-shaped vertically aligned locking member bar, a vertically aligned through hole within said locking member for receipt of said locking member bar, a horizontally aligned closed threaded hole in said locking member and a horizontally alignable threaded locking member bolt insertable into a said closed threaded hole;

d. a pair of horizontally aligned locking members affixed to said frontal facade of said rectilinearly shaped frame unit near a bottom side thereof;

e. each of said horizontally aligned locking members consisting of an inverted L-shaped horizontally aligned locking member bar, a horizontally aligned through hole within said locking member for receipt of said horizontally aligned locking member bar, a closed threaded base hole in said locking member and a horizontally aligned threaded locking member base bolt insertable into a said closed threaded base hole;

f. a pair of horizontally aligned bubble level components affixed to a right lateral side of said rectilinearly shaped frame unit;

g. a plurality of adjustable hinge components affixed by way of a pair of equivalent base units to said right lateral side of said rectilinearly shaped frame unit:

h. each of said adjustable hinge components consisting of said pair of equivalent base units, a unit plate, a vertically aligned hinge bar unit, a vertically aligned hinge bar through hole in each said base unit for receipt of one of said hinge bar unit, a horizontally inclined closed threaded hinge component hole in said plate, a horizontally inclined hinge bar tightening bolt insertable into said hinge component hole, and a pair of hinge hook units affixed to said hinge bar unit.

i. a pair of adjustable, horizontally aligned stabilizing members affixed to said right lateral side of said rectilinearly shaped frame unit;

j. each one of said adjustable horizontally aligned stabilizing members consisting of a base unit, a horizontally aligned stabilizing bar, a nail hole through said stabilizing bar, a stabilizing nail insertable through said nail hole, a threaded stabilizing member tightening bolt revolvable within a horizontally inclined threaded hole located within said each one of said adjustable, horizontally aligned stabilizing members and a sleeve for receipt of one end of one of said stabilizing bars;

k. a plurality of laterally positioned spaces located in said right lateral side of said rectilinearly shaped frame unit;

l. a plurality of laterally positioned spaces located in a left lateral side of said rectilinearly shaped frame unit;

m. a slideable bar component comprising a medial portion of said bottom side of said rectilinearly shaped frame unit and held within each of a pair of bottom side compartments found one each within respective lateral portions of said bottom side of said rectilinearly shaped frame unit;

n. a rectangularly shaped slideable scale component comprising a medial portion of said top side of said rectilinear shaped from unit held within each of a pair of top side compartments found one each within respective lateral portions of said top side of said rectilinearly shaped frame unit;

o. a threaded slideable scale holding bolt component;

p. a slideable scale holding bolt through hole for receipt of said threaded slideable scale holding bolt component;

q. a threaded slideable scale tightening bolt component;

r. a first topside closed hole for receipt of said threaded slideable scale tightening bolt component;

s. a second topside closed hole for receipt of said threaded slideable scale tightening bolt component;

t. a threaded slideable bar holding bolt component;

u. a slideable bar through hole for receipt of said threadable slideable bar holding bolt component;

v. a threaded slideable bar tightening bolt component;

w. a first bottom side closed hole for receipt of said threaded slideable bar holding bolt component;

x. a second bottom closed hole for receipt of said threaded slideable bar tightening bolt component;

y. metallic magnetic stripping affixed to an upper portion of said right lateral side of said rectilinearly shaped frame unit and to a right lateral one of said respective lateral portions of said top side of said rectilinearly shaped frame unit, and;

z. a pair of equivalent hinge pins each angulated near one end thereof and each insertable into one of said equivalent pair of hinge hooks.

8. The door frame apparatus of claim 7 whereby said slideable scale component is characterized by the presence of measurement etchings thereupon.

* * * * *